United States Patent [19]

Lisnyansky et al.

[11] Patent Number: 4,746,405

[45] Date of Patent: May 24, 1988

[54] SYSTEM FOR CELLULOSE PULP WASHING CONTROL

[75] Inventors: Khaim Lisnyansky, Chester; William E. Blecha, Warwick, both of N.Y.

[73] Assignee: International Paper Company, Purchase, N.Y.

[21] Appl. No.: 940,268

[22] Filed: Dec. 11, 1986

Related U.S. Application Data

[62] Division of Ser. No. 646,416, Aug. 31, 1984, abandoned.

[51] Int. Cl.[4] ..... D21C 9/02; D21C 9/06

[52] U.S. Cl. ..... 162/252; 162/253; 162/263; 8/156; 68/205 R

[58] Field of Search ..... 162/49, 60, DIG. 10, 162/252, 258, 263, 262, 253; 8/156, 158; 68/181 R, 205 R; 364/470, 471

[56] References Cited

U.S. PATENT DOCUMENTS

| | | | |
|---|---|---|---|
| 4,046,621 | 9/1977 | Sexton | 162/40 |
| 4,096,028 | 6/1978 | Rosenberger | 162/49 |
| 4,138,313 | 2/1979 | Hillstrom et al. | 162/49 |
| 4,207,141 | 6/1980 | Seymour | 162/49 |

OTHER PUBLICATIONS

Korhonen, "Optimum for Brownstock Washing Variable" Sep. 1978.

Luthi, "Equivelent Displacement Rate" TAPPI Proceedings 1982: Pulping Conf., pp. 45–48.

South et al., "High-Efficiency Brownstock Washing Systems", *TAPPI*, May 1978, pp. 61–63.

De Berry, "How to Measure Washer Sodium Loss More Accurately" *TAPPI*, Jul. 1980, vol. 63, No. 7, pp. 123–124.

Fisher, Pulp & Paper, Computer Control Over Brownstock Washing Minimizes Production Costs, Sep. 1979, pp. 101–103.

Korhonen, Pulp & Paper, Brownstock Washing: A Review of Current Technology, Sep. 1979, pp. 104–107.

Gulley, TAPPI, Filtrate Conductivity can give Misleading Indications of Washer Losses, Mar. 1980, vol. 63, No. 3, pp. 33–34.

Luthi, TAPPI Journal, Equivalent Displacement Ratio—Evaluating Washer Efficiency by Comparison, Apr. 1983, pp. 82–84.

Perkins, et al., TAPPI, Brownstock Washing Efficiency—Displacement Ratio Method of Determination, Mar. 1954, pp. 83–89.

*Primary Examiner*—Steve Alvo

*Attorney, Agent, or Firm*—Wayne M. Kennard

[57] ABSTRACT

A method and apparatus for monitoring and controlling the operation of a counter-current pulp washing system. The dilution factor, soda loss, wash liquor ratio and displacement ratio of the washing system are determined on-line. The value of either the soda loss or of dilution factor is continuously maintained within a preselected range and changes in the value of the other variable are monitored to provide an indication of whether the washing system is operating optimally. Based on the on-line determination of displacement ratio and wash liquor ratio, the efficiency of the washers is monitored, the cause of any decrease in efficiency is identified and the appropriate control action is applied to adjust the operating parameters of the washers to compensate for changed wshing conditions or changed processing conditions.

9 Claims, 5 Drawing Sheets

SYSTEM FOR CELLULOSE PULP WASHING CONTROL

This is a division of application Ser. No. 646,416, filed Aug. 31, 1984, now abandoned.

BACKGROUND OF THE INVENTION

Cellulose pulp is normally washed after separation of the pulping liquor at the conclusion of the digestion, before it is passed on to subsequent chemical treatment stages, such as bleaching. The pulping liquor contains substantial quantities of dissolved impurities, which react with treating chemicals, and if these impurities are not removed, or the concentration thereof at least greatly reduced, subsequent chemical treatments applied to the pulp, particularly bleaching, may be relatively ineffective, because of the consumption of such chemicals by the impurities. The impurities therefore not only reduce the bleaching effect, but may also require the addition of larger amounts of the treating agents, which are largely wasted. Dissolved impurities present in the pulping liquor after digestion include the pulping chemicals and the organic substances formed in the course of the pulping process which are water-soluble and become dissolved in the liquor. The dissolved impurities which accompany the cellulose pulp suspension must be removed by the washing.

Accordingly, the cellulose pulp washing system is designed to remove the dissolved impurities, and this is normally done by replacing the aqueous suspending liquor containing dissolved impurities with a fresh or relatively pure aqueous suspending liquid, substantially free from such impurities, or at least having a lower content thereof than the aqueous suspension from the pulper or digester.

Cellulose pulp slurries are normally washed in multiple washing stages. Usually, three or four washing stages are used. When a multiplicity of washing stages are employed, the stages are arranged in series and counter-current pulp washing techniques are used to increase efficiency. The fresh washing liquid is supplied to the last stage, and then progresses forwardly towards the first washing stage, in series along the line of washing stages. In this way, the washing liquor containing a progressively greater portion of dissolved impurities is utilized to wash the cellulose pulp fiber slurry containing a progressively greater proportion of impurities, so that the washing liquor is re-used efficiently from stage to stage. In the final washing stage, the washing liquid, often pure water, can be expected to remove substantially all of the remaining dissolved impurities. The dissolved impurities which remain in the discharged pulp slurry are referred to as washing loss or soda loss. The spent washing liquor containing the impurities dissolved from the starting cellulose pulp suspension is then collected, and the solids content can be recovered as desired.

For optimum washing efficiency, it is obviously desirable to carry out the washing with the least possible amount of washing loss, and the least possible dilution of the recovered black liquor. The key point is that a balance must be maintained between the amount of washing water used and desired pulp cleanliness. High washing losses are of course disadvantageous for many reasons. The chemicals that are lost are economically important, and their loss increases the cost of operation. Hence, it is desirable that the washing losses be kept as low as possible, while using a minimum of washing water. High washing losses also lead to problems in the subsequent treatment of the pulp. If an excessively large amount of dissolved impurities accompanies the pulp from the washing stage to the screening stage, and then on to the bleaching stage, there may be an unduly high consumption of bleaching chemicals and other treating chemicals. In terms of energy costs, overuse of shower water is expensive because all excess shower water used in the washing process must eventually be evaporated in the recovery evaporators.

Variations in washing losses can be caused by a number of different factors. For example, the volume of pulp slurry coming into the washing system can increase due to an increased production rate in the digester. This would increase the amount of impurities which must be removed by washing and can also increase the pulp consistency in the washers. Even at a stable pulp production rate, variations in the processing conditions in the digester, affected by factors such as the composition of the black liquor, the degree of delignification of the pulp cellulose and the make-up of the charge to the digester, can cause changes in the amount of impurities in the pulp slurry.

Cellulose pulp washing systems are highly specialized, and a special terminology has been developed to refer to various aspects thereof. Several of the more important and more commonly encountered terms are defined below.

Original black liquor: The pulping liquor which serves as a suspending medium for the cellulose pulp in the digester, at the conclusion of the pulping process. This liquor contains dissolved pulping chemicals, and also inorganic and organic materials produced as by-products from the pulping reaction, including organic water-soluble material dissolved from the wood.

Recovered black liquor or release liquor: The black liquor which is obtained subsequent to washing the pulp, containing the dissolved solids recovered by washing from the original black liquor. The recovered black liquor is passed to the evaporation stage, where the liquor is concentrated to a heavy black liquor or thick black liquor.

Total Soda Loss: The quantity of original black liquor sodium salts leaving the final wash stage with the pulp suspension. Soda Loss is often expressed in terms of pounds of salt cake ($NA_2SO_4$) per ton of pulp.

Washable Soda Loss (SL): That portion of the total soda loss which can be recovered by displacement washing.

Washing loss: The quantity of original black liquor dissolved solids which remains with the washed cellulose pulp suspension, after the washing has been completed. The washing loss varies according to the pulping process and the analytical technique used to determine it.

Dilution factor (DF): The difference between the volume of recovered black liquor and original black liquor, i.e., the quantity of black liquor after the addition of wash water in excess of the quantity of original black liquor charged. Dilution factor is often expressed in terms of tons or cubic meters of liquid per ton of pulp.

Displacement Ratio (DR): The fraction of the liquor entering with the pulp which is displaced by wash liquor. The ideal displacement ratio would be 1.0 where ideal wash flow existed; however, the ideal situation is not obtained. The displacement ratio is primarily a function of the dilution factor but is influenced by such factors as air entrainment in the pulp, pulp uniformity, and the temperature of the system. The displacement ratio can be determined by an analysis of the amount of dissolved solids which remain in the pulp after washing compared to the dissolved solids which would be in the pulp at the same consistency without any wash flow.

Wash Liquor Ratio (WLR): The ratio between applied wash liquor and the liquor discharged from the washers with pulp suspension per unit of pulp. In multistage countercurrent washing operations, the WLR for each washing operation stage is expressed as the ratio of volume of wash liquor applied to the pulp to the volume of liquor contained in the pulp which has been treated in the individual washing stage.

Two control methods have been generally employed by the industry to control pulp washing systems in the past. These methods are directed to controlling and optimizing the flow of wash water into the system. In the first method of pulp flow rate for the entire set of washers is estimated to be constant and the pulp flow rate is calculated for the first washer. The density of the liquor displaced from the first washing stage is measured periodically and the shower water flow on the last stage washer is then set by the operator based on this measurement. The system can be out of balance several times in the interval between measurements without detection by the operator. The average liquor solids content can be on target yet the system can be inefficient in producing both high washing losses and excessive water to be evaporated because an overwash for part of the time cannot make up for an insufficient wash the other part of the time.

Moreover, any action taken by the operator would occur long after the change in washing conditions because of the bulk inertia of the large volume of liquor in the filtrate tank and time delay before the last stage shower water reaches the first stage. Consequently, operator shower-control actions in actual situations are based on trial and error and can be grossly out of sync with changes in washing conditions. The net effect is that excessive amounts of shower water are used and soda loss fluctuates widely with a generally high average.

In the second control method, the conductivity of the liquid displaced from the pulp mat in the last washing step is measured and this measurement is used to adjust the amount of fresh washing liquid in the last washing stage.

This system is an improvement over the first stage liquor density target control method described above but has several disadvantages. The large bulk inertia of the filtrate tank, which has a buffering effect, makes the filtrate conductivity determined after the tank insensitive to the soda loss variations. Another disadvantage of this method is a poor correlation between the measured soda content of filtrate and soda content of the liquor discharged with pulp from the washer.

One proposed system employs feedforward control based on an estimate of dissolved solids in the pulp slurry entering the washing system. Flow rates and conductivity measurements made on-line as the pulp slurry enters the washing zone are used to estimate the amount of dissolved solids using mass balances of liquors and of dissolved solids. The estimate of the flow of dissolved solids leaving the next to last washing stage is used to adjust washing variables in the last stage suitably. The slurry leaving the next to last washer is high consistency pulp, 10–15%, which must be diluted with recycled liquor to 1.2–1.5% consistency before it enters the last washer. The estimate of dissolved solids entering the last washer is determined from the difference between the measurements on the diluted pulp slurry and on the diluting liquor. This approach avoids the problem of making measurements on high consistency pulp, but because of the large dilution, small errors in these measurements generate large errors in the estimate of dissolved solids entering the washer.

Another proposal incorporates on-line determination of dilution factor and uses a feedback control to maintain a constant dilution factor by changing the shower flow to the washers. Capacitive or microwave moisture sensors are used to determine the amount of water content present in a pulp web just before removal of the pulp in the form of a mat from the washing system. The disadvantage of this method lies in the difficulty of accurately measuring the water content in the mat. The conductivity variation of the liquid in the mat (amount of composition of dissolved solids) and entrapped air cause major difficulties in measuring the amount of water in the mat. A relatively small error in measuring the amount of water in the mat can cause a substantial inaccuracy in estimating the dilution factor which is determined as the difference of two flows, shower water and water discharged with pulp.

Another proposed system of pulp washing control is based on an on-line determination of the soda loss with pulp leaving the last stage of the washers. Pulp leaving the last stage of washers is diluted to 2–5% weight consistency, then the consistency and flow of diluted pulp and the flow of diluent is measured. Based on these measurements, the amount of pulp and liquid leaving the washers is determined. The concentration of dissolved solids in the diluted pulp slurry is determined calorimetrically. In order to compensate for dissolved solids, which are introduced into pulp suspension with diluent, the concentration of dissolved solids in the diluent must also be determined calorimetrically.

Although this method might be used for feedback control of the washing process based on on-line determination of soda losses, its applicability is limited because it requires an uneconomical dilution of the washed pulp going into storage. The large number of measurement instruments required limits the accuracy of the system because of cumulative measurement errors.

Another problem with pulp washing control is to optimize the performance of the washers themselves. Information about soda loss values alone is insufficient to perform washer optimization, because an increase in soda loss might be caused by a change in a variety of factors, for example, insufficient shower water applied (increase of pulp production rate), increased soda load (more soda per ton of pulp comes from digester in the black liquor and pulp slurry) or variation of washing conditions at the washers (high ingoing pulp slurry consistency, low level of pulp slurry in the washer vat, etc.). None of the methods discussed above can differentiate the actual cause of the increased soda loss or apply the appropriate control actions in order to compensate for the change and return the pulp washing system to optimum performance. Generally, the methods proposed to date assume that the washers have been set to optimal performance by the operator. That assumption may be valid for steady state pulp processing conditions, but it is not valid for dynamic pulp processing conditions under which water efficiency and thus overall system efficiency may decrease significantly.

SUMMARY OF THE INVENTION

The present invention provides for on-line determination of the soda loss, dilution factor, wash liquor ratio, and displacement ratio of a counter-current pulp washing system. These determinations are based on measurements made on the pulp slurry stream and the wash water stream rather than in filtrate tanks to eliminate bulk inertia problems. The value of either the soda loss or of dilution factor is continuously maintained within a preselected range annd changes in the value of the other variable are monitored to provide an indication of whether the washing system is operating optimally. Based on the on-line determination of displacement ratio and wash liquor ratio, the efficiency of the washers is monitored, the cause of any decrease in efficiency is identified and the appropriate control action is applied to adjust the operating parameters of the washers to compensate for changed washing conditions or changed processing conditions.

It is an object of the invention to provide an improved control system for cellulose pulp washing systems.

It is an object of the invention to provide an automatic instrumentation and control system for optimizing the efficiency of individual washers in a multi-stage pulp washing system.

Another object of the invention is to provide a system for on-line monitoring of the soda loss of a pulp washing system which can determine soda loss from measurements made on the high consistency pulp slurry discharged from the washing system without dilution of the high density pulp slurry.

Another object of the invention is to provide a system for making an on-line determination of the dilution factor and also for making an on-line determination of the displacement ratio for a pulp washing system.

A further object of the invention is to provide an instrumentation and control system for a pulp washing system which can distinguish among process disturbances which cause a deterioration of washing performance and selectively provide the appropriate control response to return the washing performance to its optimum level.

DESCRIPTION OF THE PREFERRED EMBODIMENT

The present invention is further illustrated by the following example of a countercurrent vacuum-filter washing system. The invention is particularly applicable to brown stock washing.

Figure 1:
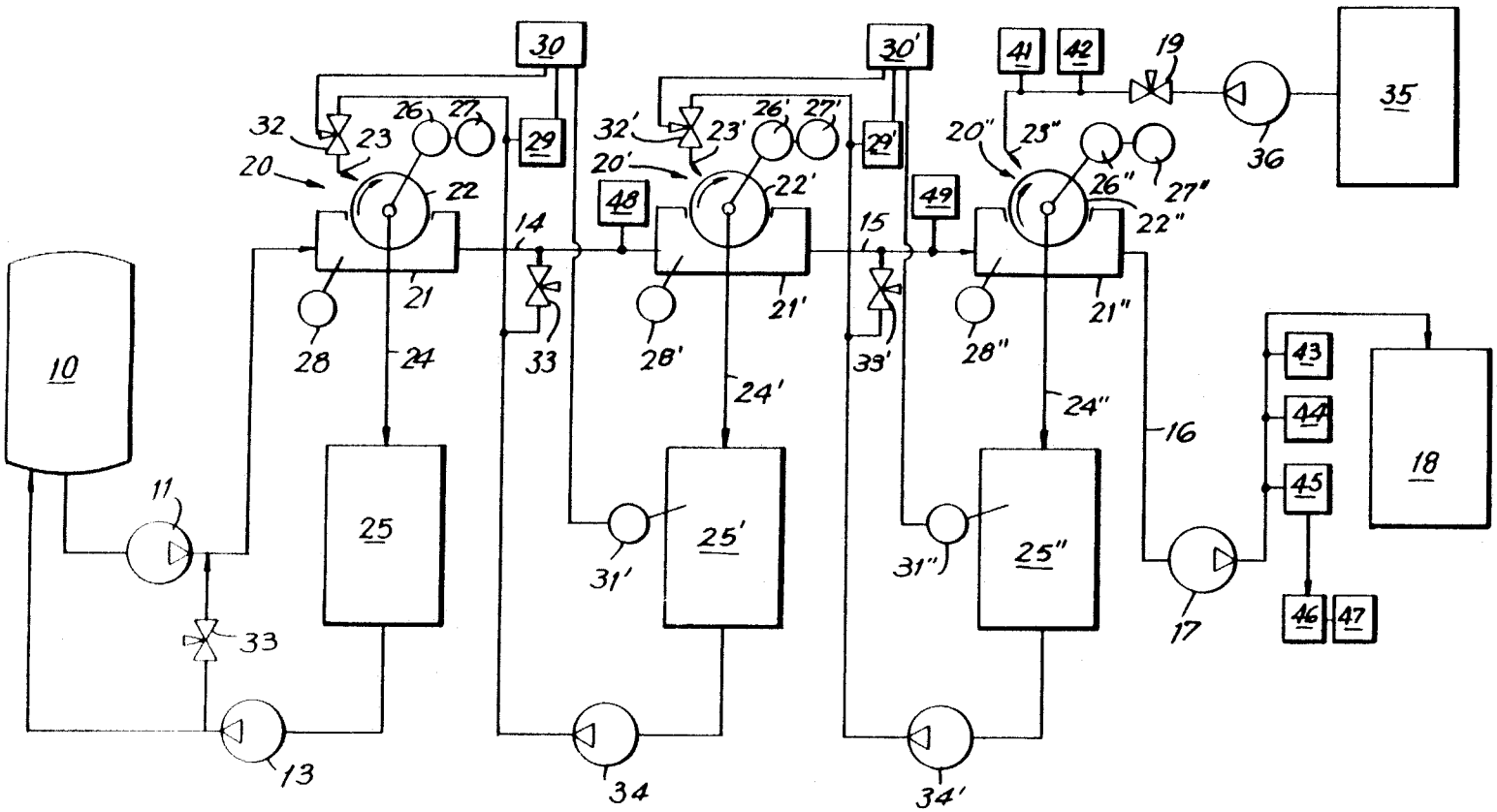
FIG. 1 is a schematic diagram of a counter-current pulp washing system which incorporates the instrumentation and control system of the present invention.

FIG. 1 shows a schematic of a three-stage countercurrent vacuum-filter washing system. Each stage incorporates a vacuum washer 20, 20', 20'', with the stages connected in series, i.e. the output of the first stage washer is fed to the input of the second stage washer, the output of the second stage washer is fed to the input of the third stage washer.

The three vacuum washers operate in substantially the same manner. The components of the second and third stage vacuum washers which correspond to components of the first stage washer are numbered to correspond with the numbers of the first stage components, with a prime to indicate the second stage and two primes to indicate the third stage. Thus, for example, the drums of the first, second and third stage washers are numbered 22, 22' and 22'' respectively.

The pulp and original black liquor enter this system from blow tank 10 by means of pump 11 through pipeline 12 which feeds vat 21 of the first stage washer. Wash water enters the washing system at the opposite end through the third stage washer shower nozzles 23'' by means of pump 36. The pulp and wash water thereafter move through the wash system in opposite directions, establishing a counter-current flow of pulp and wash liquor.

Each vacuum washer utilizes a drum or cylinder 22, 22', 22'' that rotates in vat 21, 21', 21'' which contains the pulp slurry. The lower section of each drum is submerged in the pulp slurry. Vacuum is applied to the interior of the drum and as the drum surface rotates through the slurry, it picks up a web of pulp fiber. As the drum surface emerges from the pulp slurry, the vacuum begins to drain the black liquor from the pulp. The drum then carries the pulp web under an array of nozzles 23, 23', 23'' where washing liquor is sprayed on the pulp web. The strong liquor in the pulp web on the drum is displaced by the wash liquor which flows into the pulp web under the suction of the vacuum. The displaced liquor is transferred through drop line 24, 24', 24'' to the liquor storage tank 25, 25', 25''.

The wash liquor for the first stage washer is drawn from the second stage washer liquor storage tank 25' by pump 34. Similarly, the wash liquor for the second stage washer is drawn from the third stage washer liquor storage tank 25'' by pump 34'. Wash water for the third stage washer is drawn from wash water storage tank 35 by pump 36 and may be fresh water or recycled water with a relatively low concentration of dissolved solids, for example the condensate from the recovery evaporators. The recovered black liquor from the first stage liquor storage tank is used to dilute the pulp in blow tank 10 or in pipeline 12 as necessary via pump 13 and valve 33. The excess is sent to the recovery evaporators where the water is evaporated to recover the black liquor solids.

As the drum rotates farther, the vacuum is cut off and the pulp web is removed from the surface of the drum. The pulp is then fed to the vat of the next stage washer through pipelines 14 and 15. At this point, a considerable amount of liquor has been removed from the slurry and the pulp has a relatively high consistency, in the range of 8–15%. As the pulp moves through pipelines 14 and 15, it must be diluted with liquor from the liquor storage tank of the next stage. Typically, the pulp is diluted to a consistency in the range of 1.0–1.5%, either in the pipeline or at the vat of the next stage washer, to provide for the proper formation of the pulp web on the drum of the washer.

After final washing by the third stage washer 20'', the pulp is pumped via outlet line 16 by high density pulp pump 17 into a high density pulp storage tank 18 where the pulp is stored at a consistency of 8–15%.

Operation of the Control System

For each pulp washing system, there is a set of optimum operating conditions which produces a minimum of combined soda loss and evaporation costs. One way to control the soda loss and evaporation costs is to determine the dilution factor associated with the optimum operating conditions, establish that optimum dilution factor is a target, and maintain the target dilution factor by controlling the flow of shower wash water into the system.

Figure 3:
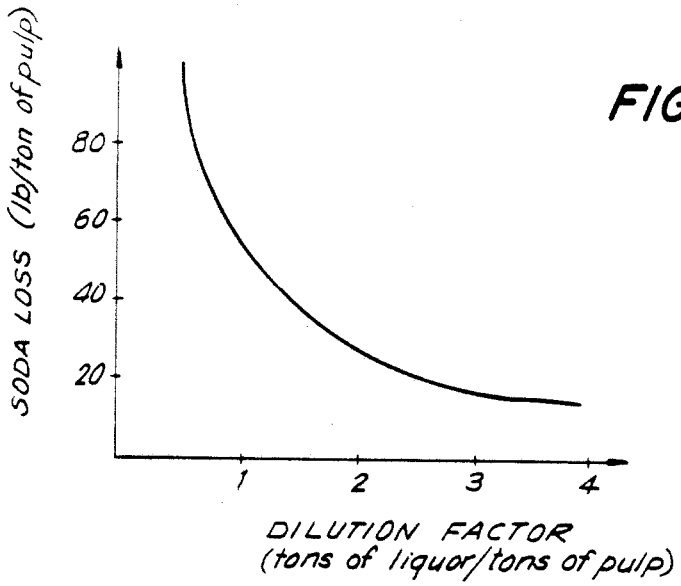
FIG. 3 illustrates the relationship between soda loss and dilution factor for a typical pulp washing system.

Soda loss and dilution factor are interrelated variables. For constant processing conditions and washing efficiency, the relationship of soda loss to dilution factor is shown in FIG. 3. It can be seen that as dilution factor increases, i.e., more wash water is used, the soda loss decreases, i.e., more soda is recovered by washing. FIG. 3 also shows that there is a diminishing return of soda recovered as dilution factor increases and larger amounts of wash water are used.

Because of this interrelationship between soda loss and dilution factor, it has generally been the practice to monitor only one of these variables as a basis for controlling a pulp washing system.

Figure 4:
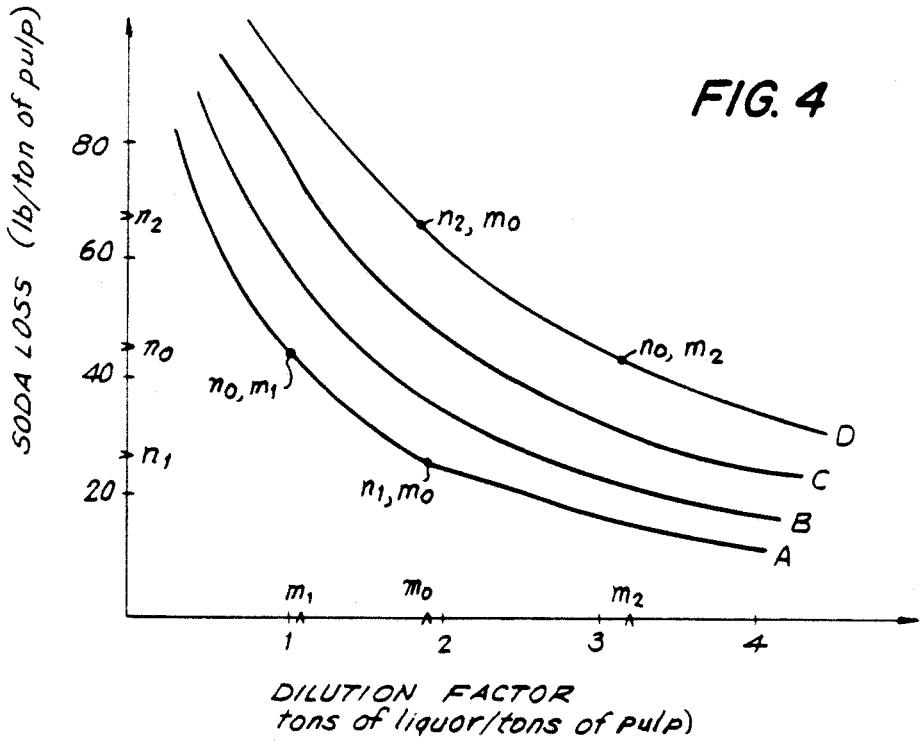
FIG. 4 illustrates the relationship between soda loss and dilution factor over a range of processing and washing efficiency conditions in a pulp washing system.

However, when the processing conditions or the washing efficiency of the system changes, the simple relationship between soda loss and dilution factor no longer applies. The actual soda loss-dilution factor relationship for varying processing conditions and washing efficiencies is shown in FIG. 4. A family of curves A, B, C and D represent the soda loss-dilution factor relationship under various processing and washing conditions.

Optimization of the pulp washing system cannot properly be achieved by monitoring only soda loss or only dilution factor. Referring to FIG. 4, if only soda loss is monitored and maintained, for example at level target $n_o$, dilution factor can vary anywhere between $m_1$ and $m_2$ depending on washing efficiency and soda load. Similarly, if only the dilution factor is monitored and maintained, for example at target level $m_o$, soda loss can vary anywhere between $n_1$ and $n_2$, again depending on washing efficiency and soda loss. If washing efficiency degrades from the optimum, either excess soda loss or excess wash water usage can occur with no indication to the operator of a change in the monitored variable.

In order to properly optimize the washing system, therefore, both soda loss and dilution factor should be monitored.

The present invention includes novel monitoring systems for determining both soda loss and dilution factor. These systems are capable of monitoring those factors on-line, with minimal or no delay, so that the operation of the washing system during changes in processing conditions can be quickly analyzed and optimized. By making a prompt corrective response to changing process conditions, the losses associated with the time-lag adapting the washing system to the new conditions may be reduced or eliminated.

Instrumentation and Control Devices

The locations of the instrumentation and process control devices with respect to the apparatus of the three-stage countercurrent vacuum-filter washing system described as the preferred embodiment are shown schematically in FIG. 1.

Figure 6:
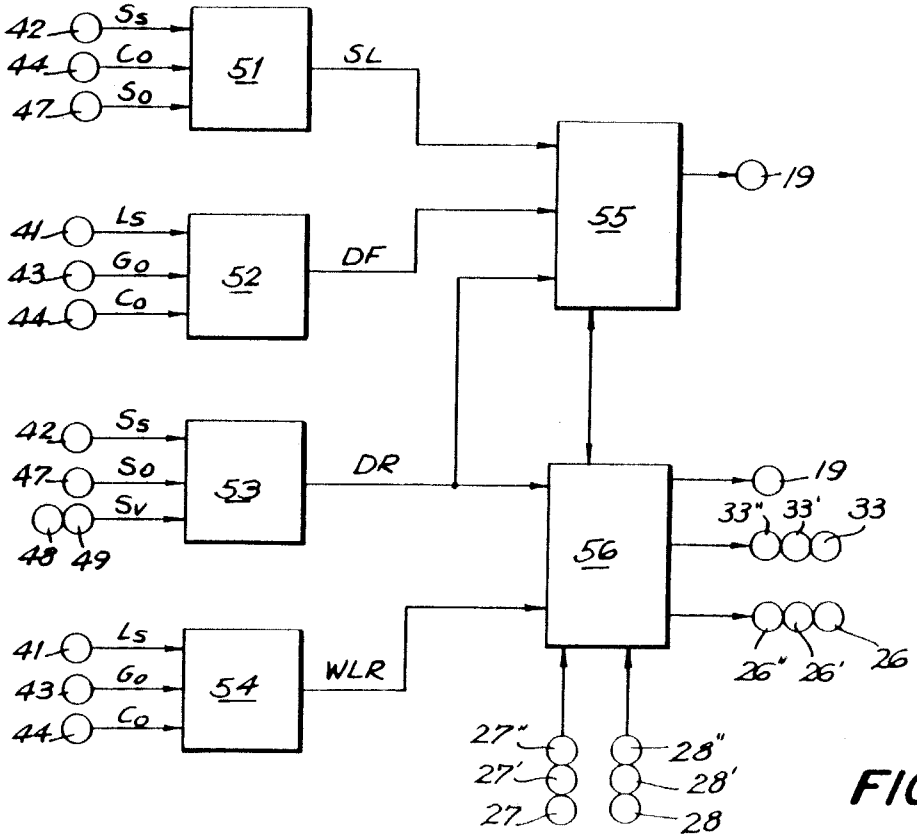
FIG. 6 is a schematic diagram of the instrumentation and control system shown in FIG. 1, illustrating the processing of signals from the measurement instruments to produce control signals for process control devices.

FIG. 6 shows a schematic diagram of the instrumentation and control system, illustrating the processing of signals from the measurement instruments to produce control signals for process control devices.

The shower flow ($L_s$) to the third stage washer is measured with flowmeter 41. The shower flow to the first and second stage washers is measured by flowmeters 29 and 29' and controlled by control units 30 and 30', which operate control valves 32 and 32' to regulate the flow of wash liquor to the shower nozzles. The second stage shower flow is set to maintain the liquor level in the third liquor storage tank 25'' at the desired level which is monitored by level gauge 31''. Similarly the flow for the first stage shower is a function of the liquor level in the second stage liquor storage tank 25', monitored by level gauge 31'.

The speed of the rotation of the drums 22, 22' and 22'' in each washer stage is regulated by motor controls 26, 26' and 26'' respectively and monitored by tachometers 27, 27' and 27''.

The level of pulp slurry in the vats 21, 21' and 21'' is measured with level gauges 28, 28' and 28''. The slurry level in the feed vats can be controlled by changing the flow of liquor used to dilute the incoming pulp slurry in feed lines 12, 14 and 15 by control valves 33, 33' and 33''. This changes the net rate of pulp slurry flow into the vats. The slurry level is also affected by and to some extent can be controlled by manipulating the drum rotation speed and thus the rate at which pulp slurry is removed from the vats.

The flow rate of the output pulp slurry ($G_o$) in outlet line 16 is measured by flowmeter 43. An insertable magflowmeter, for instance the MMI 280 Marsh McBirney flowmeter, is suitable for this application.

The pulp consistency of the output pulp slurry ($C_o$) in line 16 is measured by pulp consistency gauge 44. A consistency gauge, such as the Eur-Control model MPK41 or the CONSI gauge from Systematix Controls Inc., is suitable for measurement of pulp slurries with consistencies in the range of 8–15%.

The inorganic concentration (soda concentration) of the wash liquor delivered to the third stage shower nozzles ($S_s$) is measured with conductivity sensor 42. The inorganic concentration (soda concentration) of the liquor in the input pulp slurry ($S_v$) for the second and third stage washers is measured with conductivity sensors 48 and 49.

The inorganic concentration (soda concentration) of the liquor in the output pulp slurry from the third washer is difficult to measure because of the high consistency of the discharge pulp slurry. It is desirable to maintain the highest possible consistency in the outgoing slurry to minimize the volume required to store the washed pulp before it is sent to the next production process. The problem of measuring the inorganic concentration of a high consistency pulp slurry has in the past greatly hindered the attempts to achieve a straightforward determination of soda loss and dilution factor in counter-current pulp washing systems.

Figure 2:
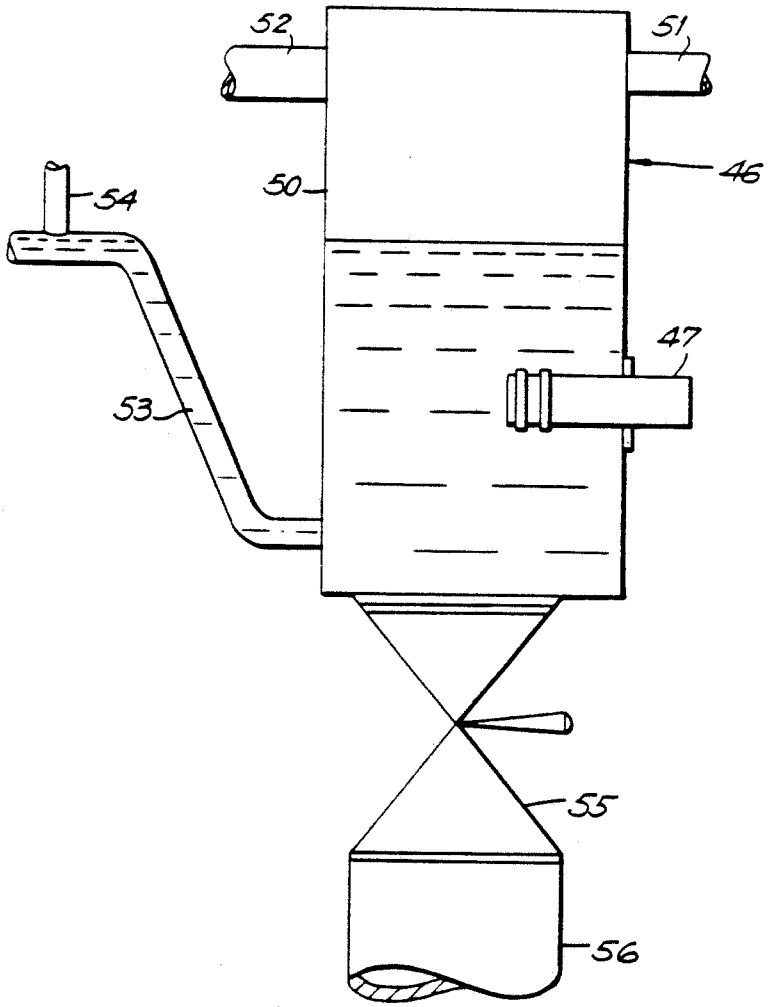
FIG. 2 shows in more detail the separation pot 46 of the soda loss measuring apparatus.

The novel measuring arrangement of the present invention solves the problem of measuring the inorganic concentration of the liquor in a high consistency pulp slurry. The apparatus comprises sampling device 45, a separation pot 46 and a conductivity probe 47. The sampling device 45 continuously withdraws a sample of liquor from the high density pulp slurry in outlet line 16 and transmits the sample to separation pot 46. The sampling device is installed downstream from pump 17 on outlet line 16 at a point where the static pressure in the line is greater than 7 psi. That pressure is sufficient to use a commercially available sampling device such as the SAMPLEX model from Kajaani, Inc. Separation pot 46, shown in FIG. 2, comprises a cylindrical vessel 50 having an inlet port 51 to receive sample liquor and an outlet port 52 to allow air to escape located near the top. A liquor outlet line 53 is constructed to maintain a constant level of sample liquor in the separation pot. Vent 54 in line 53 breaks the vacuum generated by liquor flow through line 53. Pulp fibers which enter vessel 50 in the stream of sample liquor are collected at the bottom of vessel 50 and removed periodically via drain valve 55 and discharge line 56. A conductivity probe 47 is inserted through a port in vessel 50 below the top of the liquor level maintained in the separation pot.

This arrangement greatly decreases the influence of the conductivity measurement by the pulp fibers and also decreases the variation of the conductivity measurement otherwise caused by air entrapped in the liquor. Conductivity of air and fiber differs substantially from that of liquor. The relatively small volume of the liquor separation pot eliminates the bulk inertia problems of sampling liquor from larger vessels. The arrangement thus provides for consistently reliable measurement of the inorganic concentration of the liquor in the pulp leaving the last washing stage ($S_o$).

This measurement in turn can be used to determine the soda loss for the wash system, as described below.

The washable soda loss per unit of pulp production (SL) is the difference between the amount of soda discharged per unit of pulp and the amount of soda added to the pulp with the shower water:

$$SL = \frac{S_o L_o}{P_o} - \frac{S_s L_o}{P_o} = (S_o - S_s)\frac{L_o}{P_o} \quad (1)$$

where $S_o$=soda concentration in discharged liquor
$L_o$=flow rate of discharged liquor
$S_s$=soda concentration in shower liquor
$P_o$=flow rate of discharged pulp fiber Pulp consistency ($C_o$), which is a measured quantity, can be expressed as:

$$C_o = \frac{P_o}{L_o + P_o} \quad (2)$$

from which we derive:

$$\frac{L_o}{P_o} = \frac{1 - C_o}{C_o}$$

which can be substituted into soda loss expression (1) to yield:

$$SL = (S_o - S_s)\frac{1 - C_o}{C_o} \quad (3)$$

Thus, soda loss for the system can be determined from three quantities measured by the instrumentation apparatus of the invention: $S_o$—the soda concentration in the discharged liquor, measured by conductivity probe 47; $S_s$—the soda concentration in the shower liquor, measured by conductivity sensor 42; and $C_o$—the pulp consistency in the discharged pulp slurry, measured by consistency gauge 44. Referring to FIG. 6, the signals from conductivity sensor 42 ($S_s$), consistency gauge 44 ($C_o$) and conductivity probe 47 ($S_o$) are fed to signal combiner 51 which determines the soda loss (SL) according to equation 3, above.

The dilution factor (DF) is also determined based on quantities measured on-line. By definition, the dilution factor is the amount of wash water added to the washing system per ton of pulp which enters the wash liquor counter flow and thus dilutes the black liquor which entered the system with the pulp slurry from the blow tank and can be expressed as:

$$DF = \frac{L_s - L_o}{P_o} \quad (4)$$

where $L_s$=flow rate of shower liquor
$L_o$=flow rate of discharge liquor
$P_o$=flow rate of discharge pulp fiber The flow of discharge liquor $L_o$ and the flow of discharge pulp fiber $P_o$ combine to make up the total pulp slurry discharge flow and thus $P_o$ and $L_o$ can be expressed in terms of the slurry discharge flow rate $G_o$ and the pulp fiber concentration $C_o$: $P_o = C_o\ G_o$; $L_o = (1 - C_o)\ G_o$. Thus the dilution factor can be expressed as:

$$DF = \frac{L_s - G_o(1 - C_o)}{C_o\ G_o} \quad (5)$$

Using this relationship the dilution factor can be determined from three quantities measured by the instrumentation of the invention: $L_s$—the flow rate of shower liquor, measured by flowmeter 41; $G_o$—the flow rate of discharge pulp slurry, measured by flowmeter 43; and $C_o$—the pulp concentration of the discharge pulp slurry, measured by pulp consistency gauge 44. Returning to FIG. 6, the signals from flowmeter 41 ($L_s$), flowmeter 43 ($G_o$) and pulp consistency gauge 44 ($C_o$) are fed to signal combiner 52 which determines the dilution factor (DF) according to equation 5, above.

If the operation of the system has moved from the targeted optimal values for soda loss or dilution factor, some corrective action must be taken. For example, assume soda loss has increased from level $n_o$ to level $n_2$. Such a change could be due to changing washing conditions—poor mat formation (higher ingoing pulp consistency, lower vat level), poor drainage (lower vacuum, lower shower wash water temperature) or other washing factors. The change could also be due to increased soda load or to increased production rate. The proper corrective action depends on the nature of the cause of the change. For an increased production rate, the proper action is that which would correct the soda loss and dilution factor, increasing the wash water flow rate.

For increased soda load, the proper action is again to increase the shower wash water flow rate, but to maintain either a targeted soda loss or dilution factor, the other factor must be increased. Because the washing system is already at its best efficiency, any change in the washing variables would make the soda loss problem worse, not better.

However, if washing efficiency has decreased due to changed washing conditions, the proper action is to adjust the washing system operating parameters. Increasing the shower wash water flow rate would needlessly and wastefully increase the dilution factor.

By employing the instrumentation and control system of the present invention, washing efficiency can be monitored and optimized by determining two additional factors, displacement ratio and wash liquor ratio.

The displacement ratio (DR) is defined as the ratio of the actual reduction of soda concentration across the washer compared to the maximum possible reduction. Thus, $$DR = \frac{S_v - S_o}{S_v - S_s} \tag{6}$$

where $S_v$=soda concentration in the inlet slurry liquor $S_o$=soda concentration in the discharge liquor $S_s$=soda concentration in the shower liquor The wash liquor ratio (WLR) is defined as the ratio of the flow rate of discharge liquor compared to the flow rate of shower liquor. Thus, $$WLR = \frac{L_o}{L_s} \tag{7}$$

where $L_o$=flow rate of discharge liquor $L_s$=flow rate of shower liquor

Wash liquor ratio can also be expressed in terms of total pulp slurry discharge flow ($G_o$) and the pulp consistency of the discharge slurry flow ($C_o$):

$$WLR = \frac{(1 - C_o)\ G_o}{L_s} \tag{8}$$

Thus, the displacement ratio and the wash liquor ratio can be determined from quantities measured by the instrumentation apparatus of the invention: $S_v$—the soda concentration of the inlet slurry liquor, measured by conductivity sensor 49 and $S_o$, $S_s$, $L_s$, $G_o$ and $C_o$ measured as described above for the soda loss and dilution factor determination. Again referring to FIG. 6, the signals from conductivity sensor 42 ($S_s$), conductivity probe 47 ($S_o$) and conductivity sensor 49 ($S_v$) are fed to signal combiner 53 which determines the displacement ratio according to equation 6, above. The signals from flowmeter 41, flowmeter 43 and pulp consistency gauge 44 are also fed to signal combiner 54 which determines the wash liquor ratio (WLR) according to equation 8, above.

As an alternative to displacement ratio, a recently introduced factor, equivalent displacement ratio (EDR), which corrects DR for variations in the inlet and discharge slurry consistency for a washer, could be used. For practical applications, the inlet slurry correction can be neglected. The relationship between DR and EDR is $$1 - EDR = (1 - DR)\frac{100 - C_o}{7.333\ C_o} \tag{9}$$

Again, the equivalent displacement ratio can be determined based on DR and the $C_o$ measurement made by the apparatus of the invention.

Figure 5:
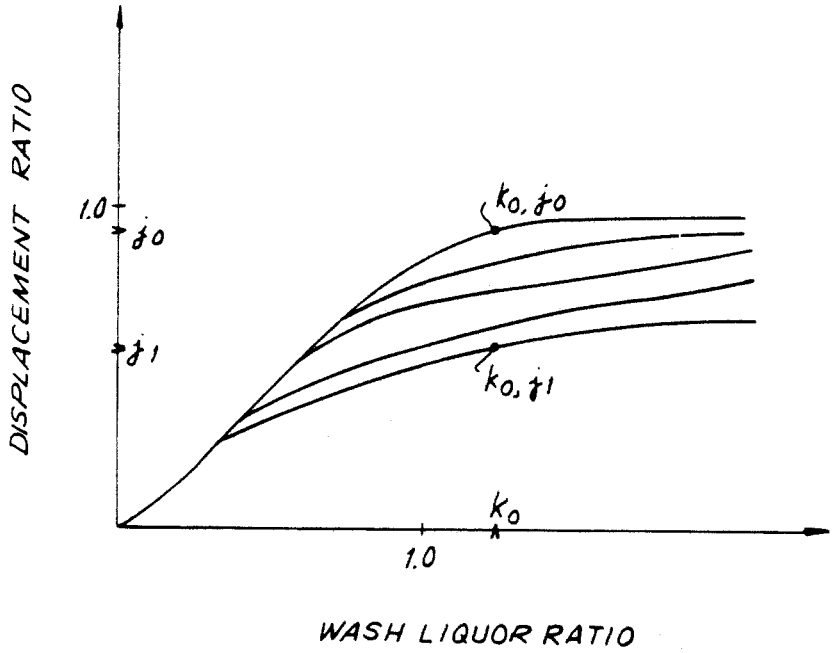
FIG. 5 illustrates the relationship between displacement ratio and wash liquor ratio for a typical pulp washing system.

The relationship between DR and WLR is shown in FIG. 5. It can be seen that DR increases with an increase of WLR. However, there can be a range of DR values for a fixed value of WLR. For example, at WLR $K_o$, DR may take on any value between $j_o$ and $j_l$. For purposes of the present invention, the importance of the DR-WLR relationship is that it is almost independent of soda load. Thus, an increased DR for a fixed WLR can only be caused by increased washing efficiency. Thus, if WLR is maintained at a target value by controlling the flow of shower water, DR is an effective indicator of washing efficiency, independent of changes in soda load.

With this additional information, the proper corrective action to take when soda loss increases can be determined. If soda loss increases, displacement ratio is checked to determine if it has changed. If the displacement ratio has not changed, then the reason for the soda loss increase is increased soda load and the proper corrective action is to increase the flow of shower water until the targeted soda loss level is achieved at a higher dilution factor. If the displacement ratio has decreased and washing efficiency has decreased the proper corrective action is to optimize the operation of the washing system.

The soda loss, dilution factor, displacement ratio and wash liquor ratio output signals may be fed to a signal processor, such as a suitably programmed computer, to automatically determine the proper corrective control action. Referring again to FIG. 6, the SL, DF and DR signals are fed to processor 55. Processor 55 monitors SL and maintains DF within a targeted range of values. This is accomplished by a control signal output to valve 19 which regulates the flow of shower water to the third stage washer. Processor 55 determines when it is necessary to optimize the washing system by monitoring the DR signal. When optimization is required, processor 55 sends an output signal to a second processor 56 to initiate the optimization procedure and transfers control to processor 56.

The soda loss (SL), dilution factor (DF), displacement ratio (DR) and wash liquor ratio (WLR) output signals from the signal combiners may alternatively be fed to a digital display device or chart recorder from which a human operator can use the information to take the proper corrective control steps.

Optimization of the washing system, using the instrumentation and controls system of the present invention is accomplished by the following procedure.

The speed of rotation of the drum 22'' of the third stage washer is varied by activating motor control device 26'', monitoring the drum speed with tachometer 27'' and also monitoring the DR value. WLR for the third stage is maintained at its target value by controlling the shower flow with valve 19. If DR decreases, the direction of the change of speed is reversed. Thus the maximum DR value and the corresponding drum speed is determined.

Next the level of pulp slurry in the vat 21'' of the third stage washer is varied by operating valve 33'' to change the flow rate of pulp slurry into vat 21" while monitoring the pulp slurry level with gauge 28" and also monitoring the DR value. When the maximum DR is established, the corresponding vat level is maintained by controlling valve 33".

At the new vat level, the optimum drum speed must be reestablished using the procedure described above. By several iteration steps (generally three or four should be sufficient) the maximum DR value and corresponding optimum drum speed and vat level conditions can be achieved.

Other washing variables, for example, pulp temperature, liquor pH or defoamer use can be included in the optimization procedure.

After the washing conditions in the third stage have been optimized, the second stage washer is optimized by following a similar iterative procedure changing the washing variables and monitoring the result, using the drum speed tachometer 27', motor control 26', vat level gauge 28' and control valve 33' for that washer. The DR for the last two stages is determined from Equation 6, using sensor 48 to measure the $S_v$, the soda concentration in the inlet slurry liquor to the second stage. The optimum conditions for the first stage washer are set to be the same as those for the second stage. Alternatively, the first stage washer conditions can be independently optimized using the monitoring and iteration procedure outlined for the second and third stages.

When washing efficiency optimization for the individual washers has been completed, the soda loss or dilution factor for the washing system can be returned to the target value by operating valve 19 to adjust the flow of shower wash liquor to the third stage washer, while maintaining drum speed, vat level and other optimized washing condition variables at the determined optimum values.

It will be appreciated by those familiar with the cellulose pulp washing art that a new instrumentation and control system for pulp washing has been disclosed herein. As a result of the many new concepts introduced, variations and modifications will be apparent to those skilled in the art, and the claims are intended to cover all such variations and modifications as fall within the true spirit and scope of the invention.

What we claim is:

1. An instrumentation and control system for a counter-current pulp washing system, in which a pulp slurry flows through one or more washing stages in one direction and a stream of wash liquor flows through the washing stages in the opposite direction, for adjusting one or more operating condition variables of the pulp washers of a washing stage so that impurities dissolved in the pulp slurry are removed from the pulp slurry and deposited in the stream of wash liquor using a minimum amount of wash liquor, comprising:

(a) means for measuring soda loss in the pulp washing system and generating a first signal representative of the soda loss;

(b) mean for measuring dilution factor of the pulp washing system and generating a second signal representative of the dilution factor;

(c) means for measuring displacement ratio of the pulp washing system and generating a third signal representative of the displacement ratio;

(d) means for measuring wash liquor ratio of the pulp washing system and generating a fourth signal representative of the wash liquor ratio;

(e) means responsive to the first, the second and the third signals, (1) means for determining when a decrease in the displacement ratio accompanies an increase in soda loss, (2) means for maintaining the dilution factor at a predetermined value, and (3) means for generating a fifth signal to indicate when a decrease in displacement ratio has accompanied an increase in soda loss;

(f) means for optimizing the washer efficiency of at least one washing stage when the fifth signal indicates a decrease in displacement ratio has accompanied an increase in soda loss, with the optimizing means further comprising, (1) means for monitoring the fourth signal and adjusting the flow of shower liquor to maintain the wash liquor ratio at a target value, (2) means for monitoring and controllably varying individual operating condition variables while monitoring the third signal to determine, for each of the operating condition variables, the value which corresponds to the maximum displacement ratio and for maintaining the operating condition variables at the values which correspond to the maximum displacement ratio, and (3) means for generating a sixth signal to indicate that the maximum displacement ratio has been achieved; and (g) means responsive to the first, the second, the fifth, and the sixth signals, for adjusting the soda loss or dilution factor of the system to a predetermined range of values, when the sixth signal indicates that the maximum displacement ratio has been achieved or when the fifth signal indicates that no decrease in displacement ratio accompanied an increase in soda loss.

2. The system of claim 1 wherein the means for measuring sode loss (SL) further comprises, (a) a first sensor for measuring the soda concentration in the liquor in the pulp slurry discharged from the pulp washing system ($S_o$), (b) a second sensor for measuring the soda concentration in the shower liquor applied to the final washing stage ($S_s$), (c) a third sensor for measuring the pulp consistency in the pulp slurry discharged from the pulp washing system ($C_o$), and (d) means connected to the first, second and third sensors which combines the output signals $S_o$, $S_s$ and $C_o$ from the sensors according to the expression, $$SL=(S_o-S_s)\,(1-C_o)/C_o$$

to produce the first signal.

3. The system of claim 1 wherein the means for measuring the displacement ratio further comprises, (a) a first sensor for measuring the soda concentration in the liquor in the pulp slurry discharged from the pulp washing system ($S_o$), (b) a second sensor for measuring the soda concentration in the shower liquor applied to the final washing stage ($S_s$), (c) a third sensor for measuring the soda concentration in the liquor in the pulp slurry at the inlet to the washing system ($S_v$), and (d) means connected to the first, the second and the third sensors which combines the output signals $S_o$, $S_s$ and $S_v$ from the sensors according to the expression, $$DR=(S_v-S_o)/(S_v-S_s)$$

to produce the third signal.

4. The system of claim 2 or claim 3 wherein the sensors for measuring soda concentration are conductivity sensors.

5. The system of claim 3 wherein the third sensor measures the soda concentration in the liquor in the pulp slurry at the final washing stage, and the displacement ratio is determined for the final washing stage.

6. The system of claim 3 wherein the third sensor measures the soda concentration in the liquor in the pulp slurry at the inlet to the next-to-final washing stage, and the displacement ratio is determined for the last two washing stages.

7. The system of claim 1 wherein the means for measuring the wash liquor ratio (WLR) further comprises, (a) a first sensor for measuring the pulp consistency in the pulp slurry discharged from the pulp washing system ($C_o$), (b) a second sensor for measuring the flow rate of pulp slurry discharged from the pulp washing system, ($G_o$), (c) a third sensor for measuring the flow rate of shower liquor applied to the final washing stage ($L_s$), and (d) means connected to the first, the second and the third sensors which combines the output signals $C_o$, $G_o$ and $L_s$ from the sensors according to the expression, $$WLR=(1-C_o)G_o/L_s$$

to produce the fourth signal.

8. The system of claim 1 wherein the means for measuring the dilution factor (DF) further comprises, (a) a first sensor for measuring the pulp consistency in the pulp slurry discharged from the pulp washing system ($C_o$), (b) a second sensor for measuring the flow rate of pulp slurry discharged from the pulp washing system ($G_o$), (c) a third sensor for measuring the flow rate of shower liquor applied to the final washing stage ($L_s$), and (d) means connected to the first, second and third sensors which combines the output signals $C_o$, $G_o$ and $L_s$ from the sensors according to the expression, $$DF=\frac{L_s-G_o(1-C_o)}{C_o G_o}$$

to produce the second signal.

9. The system of claim 1 wherein the operating condition variables include at least one of, vat level, drum rotation speed, pulp consistency in the inlet pulp slurry, liquor temperature in the washing zone, and amount of defoamer added to the washing system.

* * * * *